United States Patent [19]

Porth

[11] 4,192,448

[45] Mar. 11, 1980

[54] SELF-SEALING CLOSURE FOR MAILING BAGS

[75] Inventor: Erwin Porth, Wenningstedt, Fed. Rep. of Germany

[73] Assignee: "Wilhelmstal" Ernst & Sohn GmbH & Co. KG, Radevormwald, Fed. Rep. of Germany

[21] Appl. No.: 876,905

[22] Filed: Feb. 13, 1978

[30] Foreign Application Priority Data

Feb. 16, 1977 [DE] Fed. Rep. of Germany ..... 2706507

[51] Int. Cl.[2] ..... B65D 27/16; B65D 27/32; B65D 33/20

[52] U.S. Cl. ..... 229/80; 206/632; 229/485 B; 229/62

[58] Field of Search ..... 229/80, 62, 485 B, 58, 229/59; 206/632, 633

[56] References Cited

U.S. PATENT DOCUMENTS

| | | | |
|---|---|---|---|
| 1,212,904 | 1/1917 | Chesterton | 229/80 |
| 1,291,974 | 1/1919 | McNeil | 229/62 |
| 2,066,495 | 1/1937 | Swift | 229/80 |
| 2,074,949 | 3/1937 | Swift | 229/80 |
| 2,215,989 | 9/1940 | Wolf | 229/80 |
| 2,222,341 | 11/1940 | Stuhlman | 206/632 |
| 2,314,819 | 3/1943 | Ewer | 229/62 |
| 4,071,186 | 1/1978 | Ruda | 229/62 |

FOREIGN PATENT DOCUMENTS

| | | | |
|---|---|---|---|
| 199558 | 2/1958 | Fed. Rep. of Germany | 229/80 |
| 792102 | 8/1968 | Fed. Rep. of Germany | 229/58 |
| 2445516 | 1/1976 | Fed. Rep. of Germany | 229/80 |
| 2508746 | 9/1976 | Fed. Rep. of Germany | 229/80 |
| 458886 | 12/1936 | United Kingdom | 229/80 |
| 494159 | 10/1938 | United Kingdom | 229/80 |
| 640797 | 7/1950 | United Kingdom | 229/73 |

*Primary Examiner*—Stephen P. Garbe
*Attorney, Agent, or Firm*—Max Fogiel

[57] ABSTRACT

A self-sealing closure for mailing bags, envelopes, sacks, or similar articles, in which a strip-shaped dry latex, synthetic resin or adhesive gum coating is applied on the inside of a closure flap and on an edge zone of the backside of the mailing bag. A template flap is formed at the free end of the backside, and the magnitude of the contact area between coatings on the closure flap and the backside is variable. The template flap can be folded about a crease line, and in one position of the template flap, there is exposed a partial area of the adhesive contact surfaces, to produce a printed-matter closure. The template flap has another position in which there is exposed the complete area of the adhesive surfaces which may be brought into contact to produce a first-class letter type of seal. The template flap, moreover, has contact cutouts which may have circular, oblong, rectangular, oval or other shapes. The contact cutouts, moreover, are punched out in the vicinity of the front edge of the template flap. The width of the template flap may be narrower than the width of the coating on the backside.

5 Claims, 44 Drawing Figures

SELF-SEALING CLOSURE FOR MAILING BAGS

BACKGROUND OF THE INVENTION

The invention relates to a self-sealing closure for mailing bags, letter envelopes, sacks, etc. where, on the inside of the flap and on an edge zone of the backside, strip-like, dry latex, synthetic resin or adhesion gum coatings are applied.

Such self-sealing closures are known as permanent sealing closures for sealed first-class letters and as temporary sealing closures for printed matter. There are also known combination letter and printed matter closures which can be used as desired. For example, both closure surfaces are coated with a mixture of latex and synthetic resin dispersion which in the dry state are arepeatedly usable printed-matter closure, and in the wetted state a permanent first-class letter closure. This closure has the disadvantage that, to produce the solid first-class letter closure, a closure surface must be wetted with water, where setting times for the sealing must be observed, and the superior self-sealing method can be used only for the printed-matter closure.

With another known combination first-class letter and printed-matter closure for a double-wall mailing bag, one closure flap section has openings through which the inside of the other closure flap section is provided with dot-like sealing locations. These dot-like sealing locations, to form a printed-matter closure, can be brought into sealing contact with the backside of the mailing bag or envelope. To form a solid first-class letter closure, additional strip-like sealing areas are required on the inside of the inner closure section. Thus the solid first-class letter closure has the disadvantage that only the inner closure flap section can be connected solidly with the backside while the outer closure flap section comes into printed-matter closure contact with the backside of the mailing bag or envelope only via the dot-like sealing areas and thus is easily opened, making the inside of the mailing bag or envelope easily accessible.

It is the object of this invention to provide a self-sealing closure for mailing bags, envelopes, sacks, etc. which, without moistening, by means of an identical sealing coating on the inside allows a choice between a solid first-class letter closure of high sealing strength and a low-postage printed-matter closure which can be easily opened because of low sealing strength and, after postal inspection, can be closed again.

SUMMARY OF THE INVENTION

This object is achieved by the present invention by providing a template flap which is formed at the free end of the backside, where the size of the contact area between the coatings on the closure flap and on the backside is variable. The template flap can be folded back around a crease line; in its one position it makes available a partial area of the sealing surface to produce a printed-matter closure, and in its other position it makes available the complete area of the sealing surface to produce a sealing for first-class letters. Thus, only two strip-like dry sealing-surfaces are required; they are located on the inside of the closure flap and on the backside below the folding line. If the template flap in accordance with the present invention is folded back between both sealing surfaces, there results a temporary printed-matter closure, since only the areas exposed by the perforations of the template flap can be brought into sealing contact. If the template flap of the invention is flipped out of the way of the adhesive surfaces to be aligned, i.e., is flipped inside, the full area of the sealing surface can be used to produce a permanent first-class letter closure.

The invention has provided a universally usable self-sealing closure for mailing bags, in particular padded (insulated) envelopes; this closure is suitable both for single-layer and double-layer or double-wall closure flaps and can be used, as required, as solid first-class letter closure or as printed-matter closure to be opened and closed again. The invention is particularly suitable for padded bags which are generally used for shipping valuable objects and which have to meet rigorous requirements with respect to safety and usability under tough shipping conditions. When the self-sealing closure in accordance with the invention is used as first-class letter closure, it has increased protection against unauthorized opening. Opening is possible only by destroying the sealing surface.

In addition, the self-sealing closure of the present invention allows improved handling during postal inspection if the closure is used as printed-matter closure. In this case, the closure can be opened without difficulty and can then be closed again by self-sealing, so that the contents or parts thereof cannot become lost during the subsequent shipping, nor can they be removed illegally.

The invention makes possible simple production of a combination self-sealing closure which requires only two identical self-sealing strips for the closure fold and the backside plus a template flap formed from the end of the backside. No combination adhesives (sealers) or silicon papers, etc. are necessary. No moistening is necessary to produce a first-class letter closure, but merely a contact pressure on the self-sealing layer, and a practical rational and safe operation is assured.

The invention is explained below on several embodiments shown in the drawings.

DESCRIPTION OF THE PREFERRED EMBODIMENTS

Figures 1, 2, 3, 4, 5, 6, 7, 8, 9, 10, 11, 12, 13, 14, 15, 16, 17, 18, 19:
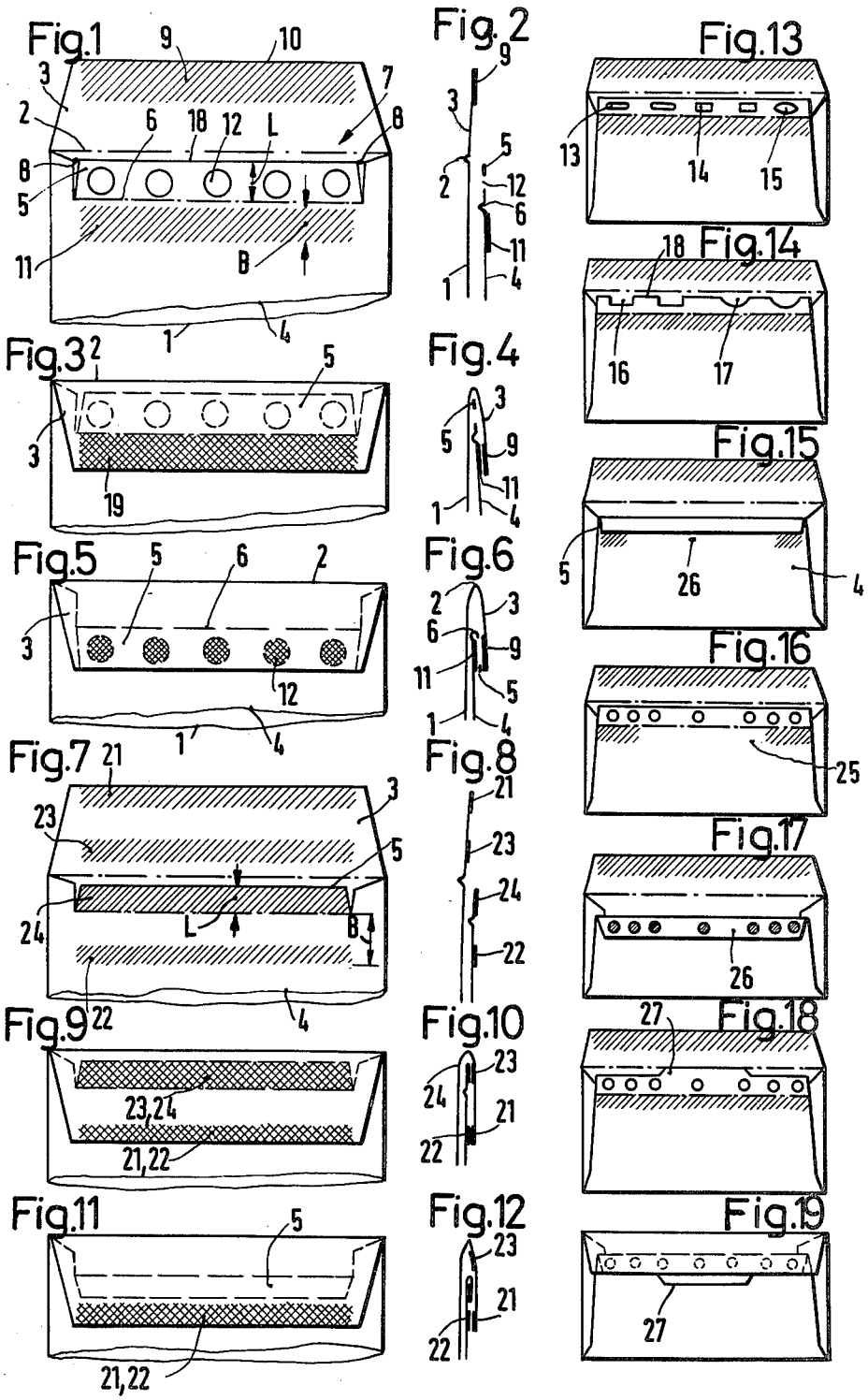
FIGS. 1 to 6 show views and sections of the first embodiment with flipped-open closure flap, as first-class letter closure with view and section, and as printed-matter closure with view and section.
FIGS. 7 to 12 shows the second embodiment with the versions similar to the first embodiment.
FIGS. 13 and 14 are various forms of contact configurations for the template flap.
FIGS. 15 to 19 show various texts of instructions, for use, printed on the envelope.
Figure 20:
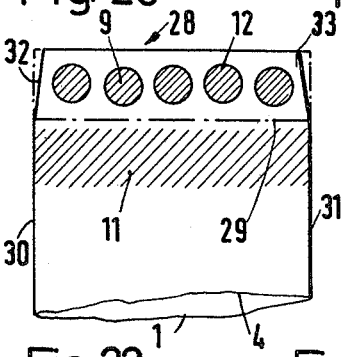
FIGS. 20 to 28 shows another embodiment with double-wall closure flap in the open position with both view and section, as printed matter closure with view and two sections, as first class letter closure with template flap flipped inside with view and section and as first-class letter closure in the closed position with view and section.
Figure 21:
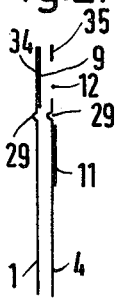
Figure 29:
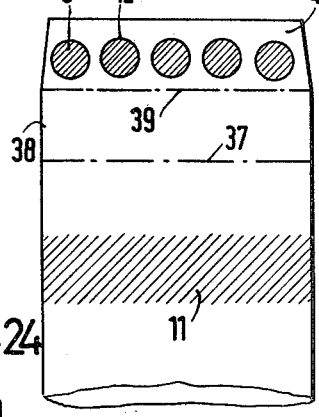
FIGS. 29 to 34 shows another embodiment with a double-layer closure flap in the open position with view and section, as first-class letter closure with view and section and as printed-matter closure with view and section.
Figure 30:
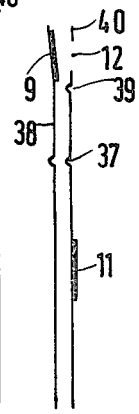
Figure 22:
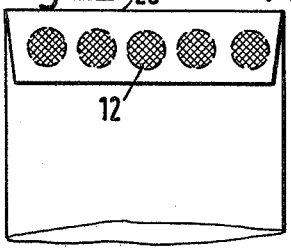
Figure 23:
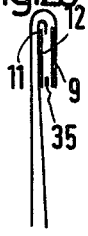

The mailing bag or envelope according to FIGS. 1 to 6 comprises a front side with a closure flap 3 separated from it by a crease line 2, a backside 4 and a template flap 5 formed from the upper portion of the backside 4; this template flap can be flipped about a crease line 6. The cuts 8 made in the opening 7 assures the mobility of the template flap 5 relative to the backside 4. A self-sealing coat 9 for the closure flap 3 runs parallel to the forward flap edge 10, and a self-sealing coat 11 runs on the backside 4 parallel to the crease line 6 such that with the closure flap 3 turned down, both coatings 9, 11 cover each other.

The template flap 5 has circular contact cutouts which may also be oblong, rectangular, oval, etc. (see reference numerals 13, 14, 15 in FIG. 13). The contact cutouts 12 to 15 may also be punched-out cutouts 16, 17 in the region of the forward edge 18 of the template flap 5 (FIG. 14). In the sealed state for a permanent first-class letter closure (FIGS. 3 and 4), the closure flap 3 in the flipped-over state through its self-sealing surface 9 has full-area contact with self-sealing layer 11 on the backside 4 (cross-hatched area 19 in FIG. 3).

Figure 24:
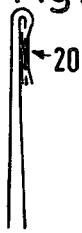
Figure 31:
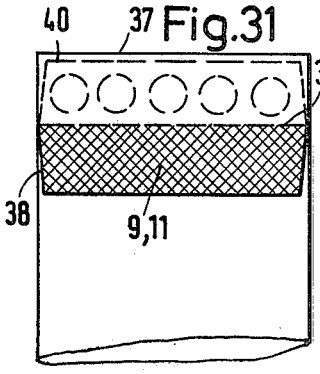
Figure 32:
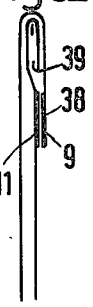
Figure 25:
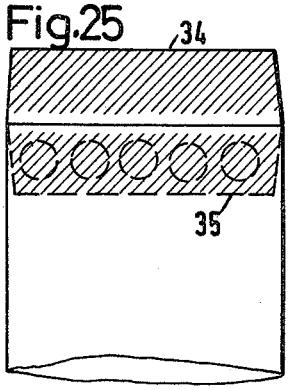
Figure 26:
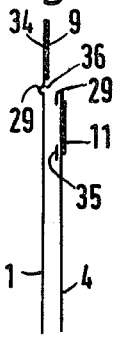
Figure 33:
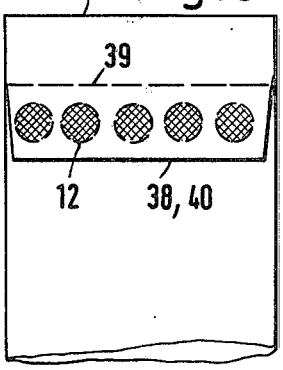
Figure 34:
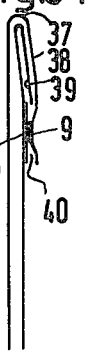
Figure 27:
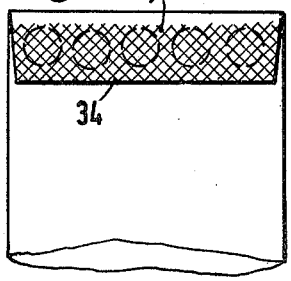
Figure 28:
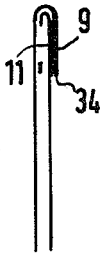
Figure 35:
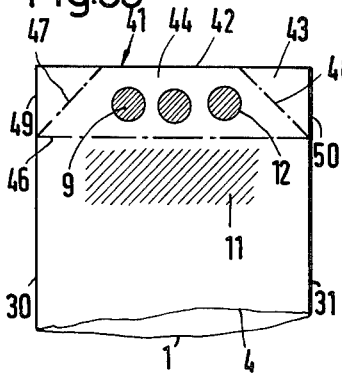
FIGS. 35 to 44 show an embodiment with double-wall closure flap with laterally closed side creases in the open position with view and section, in an intermediate position for printed-matter closure with view and section, as printed-matter closure with view and section, in an intermediate position for first-class letter closure with view and section, and as solid first-class letter closure with view and section.
Figure 36:
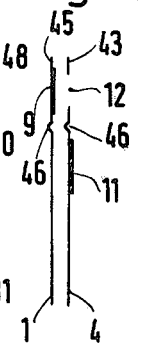

With the printed-matter closure shown in FIGS. 5 and 6, the template flap 5 is flipped about the crease line 6 to the rear of the backside 4 and covers the major portion of the coat 11 on the backside 4. Sealing contact between the self-sealing layers 9, 11 exists only through the contact cutouts 12. Since the template flap 5 is uncoated and the self-sealing layers 9, 11 of the closure cap 3 or of backside 4 have no adhesive contact with the template 5, the sealing strength of closure flap 3 is limited in this position to the contact areas 12 which are shown cross-hatched in FIG. 5. The actual adhesive contact in this position comes about only if a suitable pressure is exerted on the contact area 12 as shown by arrow 20 in FIG. 24. For this reason it is also possible to store the shipping bags with the arrangements of FIGS. 5 and 6 with the closure flap 3 down without sealing contact being produced.

A printed-matter closure formed according to FIG. 5 can be opened for postal inspection by lifting the closure flap 3 from the backside 4, where only the adhesive strength of contact areas 12 has to be overcome. After postal inspection, the inspector can place the template flap 5 in the position of FIG. 3 and produce a solid self-sealing closure as shown in FIG. 3. This is possible regardless of whether during the inspection the contact seal in the areas of the contact cutouts 12 was destroyed or not.

In the further embodiment of FIGS. 7 to 12, the adhesive strips 21, 22 for the printed-matter closure may have lower adhesive intensity and may be narrower than the strips 23, 24 used for the solid first-class letter closure. The first-class letter closure is shown in FIGS. 9 and 10. The printed-matter closure is shown in FIGS. 11 and 12, with the template flap 5 being turned over so that only the less adhesive coatings 21, 22 come into sealing contact.

Instructions for use may be printed on the template flap 5 or the backside 4 (FIGS. 15, 16, 17), such as "Letter Closure" 25 or "Printed-Matter Closure" 26. The template flap 5 may also have tab 27 for printed instructions (FIGS. 18, 19).

The use of the self-sealing closure on a mailing bag with double-layer or double-wall closure flap is shown in FIGS. 20 to 28. These shipping bags with front side 1 and backside 4 have a crease line 29 and a double-wall closure flap 28. The side creases 30, 31 are closed up to crease line 29 and are cut above the crease line 29 in the areas 32, 33; as a result, there is produced from the backside 4 the template flap 35, which is freely movable independently of the single-layer closure flap 34 and can be flipped about crease line 29; the template flap has contact cutouts 12. The self-sealing coating 9 for the closure flap 34 is placed on the inside, while the self-sealing coating 11 is placed on the backside 4 parallel to crease line 29. For a printed-matter closure (FIGS. 22 to 24), the closure flap 34, together with the template flap 35, is folded about the crease line 29 and the two self-sealing coatings 9, 11 are brought into adhesive contact through the contact cutouts 12.

For a solid first-class letter closure (FIGS. 25 to 28), the template flap 35 is flipped inside the bag or letter opening 36 and then the closure flap 34 is placed on the backside 4 so that the full contact areas of self-sealing layers 9, 11 are making sealing contact.

A modified embodiment of a double-layer closure flap with a crease line 37 for the closure flap 38 and a crease line 39 for the template flap 40, having contact cutouts 12, is shown in FIGs. 29 to 34. The self-sealing layers 9, 11 have the same distance from the crease line 37. For first-class letter closure (FIGS. 31, 32) the template flap 40 is folded over crease line 39 so that the self-sealing layers 9, 11 make full contact and a solid permanent sealing closure is produced. For the printed-matter closure (FIGS. 33, 34), the template flap 40 is between the self-sealing layers 9, 11 so that the contact area for self-sealing is reduced to the partial regions of the contact cutouts and a snap-fastener like point sealing with intensive two-layer contact sealing is achieved, which can be opened easier for postal inspection than a full-strip contact sealing.

The last embodiment shown in FIGS. 35 to 44 shows a mailing bag with double-wall closure flap where the single or double side creases 30, 31 are closed up to the free edge 42 of closure flap 41. The double-wall closure flap comprises a flap portion 43 which serves as a template flap 44 and a closure flap portion 45 which forms the closure flap proper. Both closure flap portions 43, 45 can be folded about the main crease line 46 which extends across the shipping bag from one side crease 30 to the other side crease 31.

Figure 37:
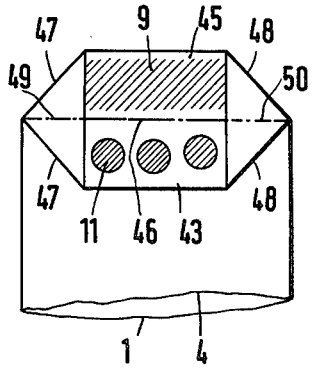
Figure 38:
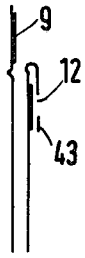

Previously it was not possible to apply the strip-like adhesive layer 9 on the inside of the closure flap portions 45 constituting the closure flap proper. This is made possible with this embodiment of a mailing bag in that both flap portions 43, 45 of the double-wall closure flap 41 have auxiliary crease lines 47, 48 inclined 45° with respect to the main crease line 46. These auxiliary crease lines extend from the intersection of the main crease line 46 with the side creases 30 or 31 to the upper free edge 42 of the closure flap. As shown in FIG. 37, using the auxiliary crease lines 47, 48, the flap portion 43 constituting the template flap 44 can be flipped forward onto the backside 4 of the mailing bag, so that the inside of the flap portion 45 forming the actual closure flap is exposed for coating with adhesive coat 9. In this position, the auxiliary crease lines 47, 48 form isosceles triangles comprising part of the two flap portions 43 and 45, and are located above the backside 4 and the template flap 44. The median perpendiculars 49, 50 of the two isosceles triangles are formed by the upper end portions of the side creases 30, 31. These median perpendiculars 49, 50 are parallel to and congruent with the main crease line 46.

Figure 39:
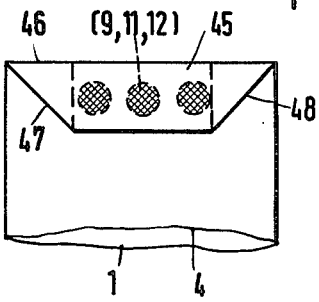
Figure 40:
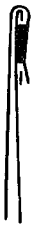

To produce a printed-matter closure, the flap portion 45 may be folded about the main crease line 46 and the two median perpendiculars 49, 50 onto the backside 4 of the mailing bag as shown in FIG. 39. In the previously described manner, there results a partial sealing between the adhesive area 9 on the flap portion 45 and the strip-like adhesive area 9, 11 on the backside of the mailing bag underneath the main crease line 46.

Figure 41:
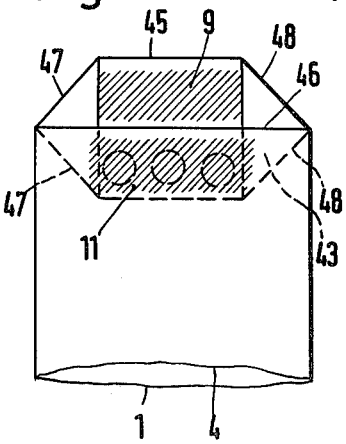
Figure 43:
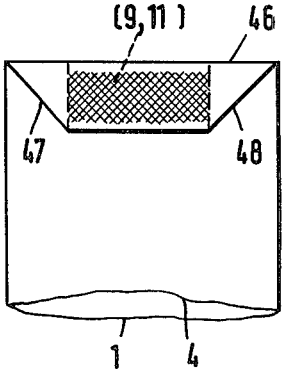

To form a solid first-class letter-closure, the flap portion 43 forming the template flap 44 may be folded about the main crease line 46, using the auxiliary crease lines 47, 48 inside the mailing bag as shown in FIG. 41. In this case, the isosceles triangle formed by the two auxiliary creases lines 47, 48 becomes located directly on the inside surface of the frontside 1 or of flap portion 45. A subsequent folding of flap portion 45 about the main crease line 46 onto the backside 4 makes possible a solid connection of the two adhesive surfaces 9, 11, so that a solid first-class letter closure is produced (FIGS. 43, 44).

Figure 42:
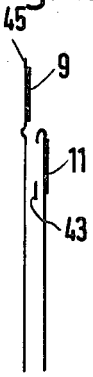
Figure 44:
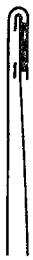

By not making the flap portion 43 a template flap, the embodiment of a mailing bag with double closure flap as shown in FIGS. 35 to 44, may also serve as a simple first-class letter closure. With such a first-class letter closure, the contents of the bag are kept especially safe by the flap portion 43 folded towards the inside, as shown in FIGs. 41, 42 and 44. This advantage applies generally to the template flap.

The crease line of the template flap may be perforated for all embodiments so that the template flap can be easily torn off to form a first-class letter closure.

The self-sealing closure may be arranged so that the width (L) of the template flap 5 is narrower than the width (B) of the coating 22 on the backside 4. Furthermore, the length of the template flap 5 may also be smaller than the length of coating 9 on the inside of the closure flap 3.

I claim:

1. A mailing bag having a backside having an upper free edge, a frontside having an upper free edge, side creases joining said frontside to said backside and self-sealing closure comprising: a closure flap; a template flap; an inside of said closure flap; adhesive means applied in strips on said inside of said closure flap and on a portion of said backside; said template flap being folded away from contact with said adhesive means and into said mailing bag for producing a first-class letter closure with complete adhesive bonding; said template flap forming a retainer flap for securing mailing bag contents inside said mailing bag; said retainer flap together with chemical closure by bonding with said adhesive means providing mechanical security against actions of the contents on the closure flap so that said closure flap is relieved and secured against damage from the contents; auxiliary crease lines in said closure flap and in said template flap; main crease lines delimiting the lower edges of said closure and template flaps; said side creases connecting said template flap to said closure flap; said auxiliary crease lines being inclined 45° from said main crease line and extending from an intersection of said main crease line with said side creases to said upper free edge, said template flap being foldable about said main crease line both outwardly onto said backside and inwardly into said mailing bag, regions of said closure flap and of said template flap located outside said auxiliary crease lines being located in a plane underneath said backside and inside said mailing bag on an inside surface of said front side.

2. A self-sealing closure as defined in claim 1 wherein said closure flap is folded about one of said main crease lines and about portions of said side creases onto said backside for forming a solid full-surface adhesive contact between said adhesive means on said inside of said closure flap and on said backside.

3. A self-sealing closure as defined in claim 1 wherein said template flap has contact cutouts.

4. A self-sealing closure as defined in claim 1 wherein said template flap has a width substantially equal to the width of said adhesive means on said backside.

5. A self-sealing closure as defined in claim 1 wherein said adhesive means is selected from the group of dry latex, adhesive or synthetic resin and similar substances.

* * * * *